US006966770B2

(12) United States Patent
Bonci et al.

(10) Patent No.: US 6,966,770 B2
(45) Date of Patent: Nov. 22, 2005

(54) ROTARY HEARTH FURNACE FOR USE IN THE IRON AND STEEL INDUSTRY

(75) Inventors: Paolo Bonci, Genoa (IT); Givseppe Facco, Pittsburgh, PA (US)

(73) Assignee: Techint Compagnia Tecnica Internazionale S.p.A., Milan (IT)

( * ) Notice: Subject to any disclaimer, the term of this patent is extended or adjusted under 35 U.S.C. 154(b) by 0 days.

(21) Appl. No.: 10/484,233

(22) PCT Filed: Jul. 24, 2002

(86) PCT No.: PCT/EP02/08328

§ 371 (c)(1),
(2), (4) Date: Jul. 1, 2004

(87) PCT Pub. No.: WO03/010476

PCT Pub. Date: Feb. 6, 2003

(65) Prior Publication Data

US 2005/0053888 A1 Mar. 10, 2005

(30) Foreign Application Priority Data

Jul. 25, 2001 (IT) ..... MI2001A1595

(51) Int. Cl.[7] ..... F27B 9/16
(52) U.S. Cl. ..... 432/138; 432/124
(58) Field of Search ..... 432/124, 138, 432/195, 141; 266/173; 414/149, 150, 154

(56) References Cited

U.S. PATENT DOCUMENTS 4,578,031 A * 3/1986 Johnson et al. ..... 432/138
5,868,566 A * 2/1999 Johnson et al. ..... 432/138
6,139,314 A * 10/2000 De Marchi et al. ..... 432/138
6,305,931 B1 * 10/2001 De Marchi et al. ..... 432/138

FOREIGN PATENT DOCUMENTS

DE 26 04 667 A 8/1976

OTHER PUBLICATIONS

EPO Search Report.

* cited by examiner

*Primary Examiner*—Gregory Wilson
(74) *Attorney, Agent, or Firm*—Hedman & Costigan, P.C.

(57) ABSTRACT

A rotary hearth furnace for use in the iron and steel industry comprises a furnace (12, 112) with plan in the shape of an annulus, closed at the bottom by a rotary hearth (14, 114), lined at the top with refractory material (15, 115), and a base (28, 128; 30, 130) of the furnace (12, 112). Said hearth (14,114) comprises a plurality of sectors of an annulus (17, 117; 17', 117'), all the same as one another and connected to form an annulus, complementary to that of the internal plan of the furnace (12, 112), which rotate around the central axis of the annulus, by means of two concentric sets of wheels (26, 126) arranged according to two circumferences, set at equal instances, with supports (25,125), fixed to the base (28) or below the hearth (114), complementary to two circular rails (20, 120), fixed respectively below the hearth (14) or the base (128). According to the invention, both said sets of wheels (26, 126) and said two rails (20, 120) are positioned in such a way as to have an equal load distribution.

9 Claims, 3 Drawing Sheets

ROTARY HEARTH FURNACE FOR USE IN THE IRON AND STEEL INDUSTRY

CROSS-REFERENCE TO RELATED APPLICATIONS

Not applicable.

STATEMENT REGARDING FEDERAL SPONSERED RESEARCH OR DEVELOPMENT

Not applicable.

BACKGROUND OF THE INVENTION

1. Field of the Invention

The present invention refers to a rotary hearth furnace for use in the iron and steel industry.

2. Description of Related Art

Rotary hearth furnaces have been used for a long time, particularly in the iron and steel sector.

Their uses are very varied. For example they are used to heat metals in ingots, slabs or blooms, before rolling; or for the heat treatment of materials, such as metal parts, glass or graphite; or again for processing loose or agglomerated raw materials such as coal or alumina, or mixtures of raw materials such as iron ore with carbon materials, or waste rich in iron with carbon materials.

Rotary hearth furnaces are built in different shapes and with a diameter varying from a few metres to more than 50 m, with width even larger than 6 m.

The hearth rotation speeds are also variable. Large heating furnaces rotate at even less than one revolution per hour, while small rotary furnaces, for calcination or for processing raw materials, reach for example fifteen revolutions per hour.

The hearth is generally in the shape of an annulus and rotates through two circumferential sets of wheels. These are located on the circumferences close to the ends of the annulus.

The wheels run on rails, and two different construction solutions are possible.

A first solution is to make wheels integral with the frame of the rotary hearth and rails fixed to the ground, mounted on very rigid structures, often made of reinforced concrete.

The second solution is to make rails integral with the frame of the rotary hearth and wheels fixed to the ground, mounted on very rigid structures, often made of reinforced concrete.

In the latter case the rotary hearth must be planned and built considering a fatigue stress in the metal structure, and consequently in its refractory lining, due to the continuous changing of the points of contact between the wheels and the rails during rotation of the hearth.

This fatigue stress may be very critical for the life of the refractory and so the furnaces are planned with wheels positioned on the two diameters, internal and external, on the same radii, so as to be able to divide the above metal structure into sectors having the same angular spacing as the wheels. In doing this, the deflection of the hearth structure due to the changing of the position of the point of contact of the wheels with the rails applied on the structure generates limited stresses and eliminates or minimises the cyclical movements of the refractory.

New processes have recently been developed in the field of the treatment of iron ore which require rotary hearth furnaces with very large hearth areas, and in some cases with very high rotating speeds, even more than 15 revolutions per hour.

These rotary hearth furnaces require hearth surfaces larger than those built up till now, with diameters even larger than 50 m and hearth widths larger than 6 m, even over 10 m.

In these furnaces certain problems, which are not important in the traditional applications, become critical when the dimensions and the rotating speeds are increased so considerably. The main problems to be tackled are the wear of the coupling between wheels and rails, and the curving of the hearth panels due to the difference in temperature in the panel supporting structure.

Normally the wheels and the rails are generally positioned on two circumferences very close to those of the ends of the hearth. Due to the geometry of the system, the wheels on the outer surface are more loaded than the wheels on the internal circumference. With the increase in the width of the hearth, this load difference is increased and consequently there may be great differences in the wear of the wheels and of the rails, which are on the two internal and external circumferences. The behaviour described above may be compensated, for example, by changing the size of the wheels and of the rails.

In these furnaces, also the planarity of the hearth is of primary importance. As is known, the supporting beams of the refractory hearth are subject to heating due to heat conduction through the hearth and at the same time they are cooled by irradiation and conduction with the environment below. This normally generates, in these supporting beams, a difference in temperature between the top and the bottom of the hearth, giving rise to a phenomenon of curving of the hearth when it reaches the working temperature.

When the width of the hearth increases, the traditional construction with frames having panels as wide as the hearth itself becomes critical on account of the strains due to said thermal effects and the consequent stresses or strains which may be generated in the refractory structure.

Moreover, since some new rotary hearth furnaces need to be installed at a considerable height above ground level, even higher than 20 metres, the high supports of the furnace, which must support the wheels or the rails of the hearth, increase the flexibility of the structure. In particular, if the structure, under the load of the hearth, generates different deflections from point to point, and particularly in an asymmetric manner, the induced stresses may be very critical, provoking functional complications and phenomena of fatigue during operation of the furnaces.

BRIEF SUMMARY OF THE INVENTION

The general aim of the present invention is to improve, in a rotary hearth furnace, the performances of the wheels and of the rails, and to decrease the stresses on the structures of the rotary hearth and of its refractory lining.

Another aim is to overcome the above-mentioned existing inconveniences of the conventional construction technique in an extremely simple, economic and particularly functional manner.

In view of the above aims, according to the present invention, it has been intended to realise a rotary hearth furnace for use in the iron and steel industry, having the characteristics stated in the enclosed claims.

The structural and functional characteristics of the present invention and its advantages with respect to the prior art will be even more clear and evident from an examination of the following description, referring to the enclosed drawings, which show a rotary hearth furnace for use in the iron and steel industry realised according to the innovative principles of the invention.

DETAILED DESCRIPTION OF THE INVENTION

Figure 1:
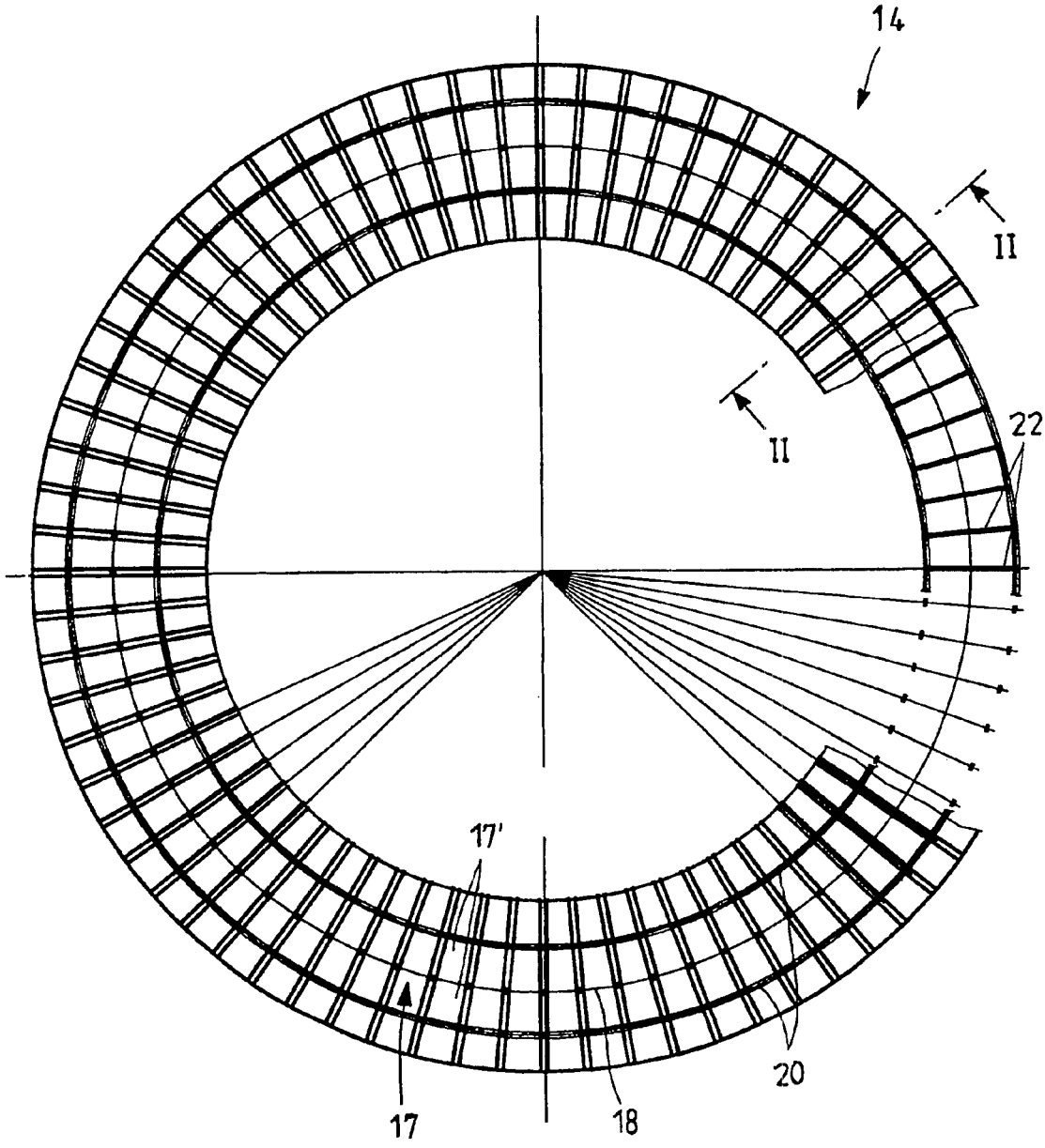
FIG. 1 shows a layout view from below of only a metal bearing structure of a rotary hearth for a furnace, according to a first realisation of a furnace of the present invention.
Figure 3:
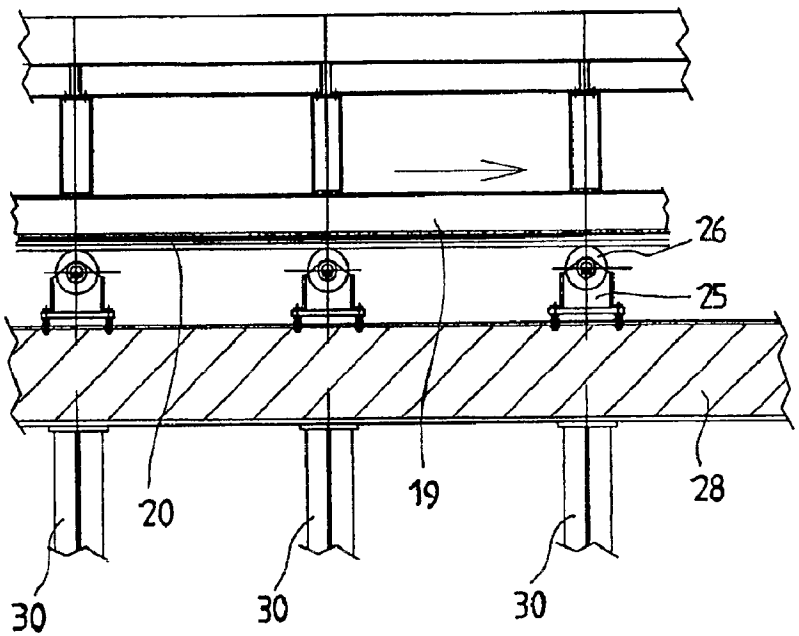
FIG. 3 is a side elevation section enlarged and developed on the plane, partly showing means for rotating the hearth according to the realisation in FIG. 2, with wheels placed on a fixed structure.
Figure 2:
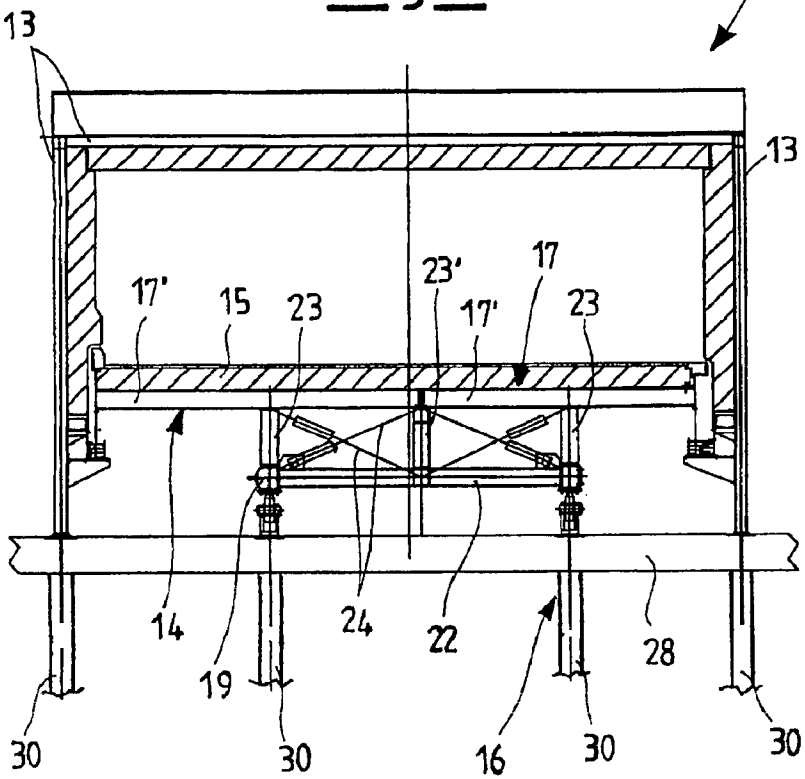
FIG. 2 is a section taken according to the plane II—II of FIG. 1, that is according to a radial plane, of a first realisation of a rotary hearth furnace for use in the iron and steel industry, the rotary hearth of which is shown in FIG. 1.

With reference above all to FIGS. 1, 2 and 3, a rotary hearth furnace for use in the iron and steel industry according to the invention, in a first possible example of an embodiment, is indicated overall as furnace 12, placed on a support structure 16 and equipped with a rotating hearth 14.

The furnace 12 has a plan in the shape of an annulus lined with refractory material and it is closed at the side and at the top by walls 13 lined on the inside with refractory material. Instead, at the bottom the furnace 12 is closed by the hearth 14, also in the shape of an annulus but rotating around a central vertical axis of the annulus. This hearth 14 is lined at the top with refractory material 15, for example with refractory panels.

The hearth 14 is composed of a series of annulus sectors 17. As well as this circumferential division of the sectors 17, there may be, as shown in FIG. 1, a radial division of the annulus of the hearth 14, breaking the sectors 17 into two semi-sectors 17' along arcs 18 of an intermediate circumference between the two end circumferences, internal and external, of the annulus.

The intermediate circumference which comprises the arcs 18 is such as to divide the sector 17 into two semi-sectors 17' of the same weight. Due to geometric considerations on the areas subtended by semi-sectors of an annulus, it is therefore larger than the median circumference of the annulus of the hearth 14.

The division into semi-sectors 17' of the hearth allows a considerable decrease of the hearth level variations due to the thermal curving of a support structure of the sectors 17 when the hearth reaches the normal working temperatures.

The semi-sectors 17' are shown above a reticular structure comprising cross members 22, uprights 23 and 23', and possibly tie rods or stiffening struts 24.

As may be seen in FIGS. 2 and 3, the reticular structure has two annular bars 19 at the bottom, concentric with the annulus of the hearth 14. These bars 19 are placed on circumferences coinciding with the centre of gravity of the sectors 17 and 17', so that the weight of these sectors is discharged directly on the system below.

Below these bars 19 there are two rails 20, having the same section.

In the example in FIG. 2 these bars 19 are placed in a position such that the weight of the hearth 14, bearing down on the two bars 19 is almost identical.

The support structure 16 comprises a base 28, placed on circumferential sets of columns 30. Fixed on this base 28 are two sets of supports 25 for wheels 26, placed along a circumference, so that the wheels 26 are complementary to and operatively aligned with the two rails 20 of the hearth 14.

The two sets of wheels 26 are placed in such a way that the pairs of wheels 26 are positioned on the same radii of two concentric circumferences, internal and external, these radii being spaced at equal distances on the same circumferences. The number of these pairs of wheels 26 is equal to those of the sectors 17. In this way the stresses due to the changing of position, during rotation of the hearth 14 itself, of the forces applied by the wheels 26 on the bars 19 and therefore on the sectors 17 and on the refractory material 15, are minimised. In fact the semi-sectors 17 and 17' are principally supported by the uprights 23 which join them vertically to one of the two annular bars 19. These uprights 23, as may be seen in FIG. 2, are in fact located in an area close to the centre of gravity of the semi-sectors 17'.

Each sector 17 is thus equipped with two uprights 23, one for each semi-sector 17', connected to the two bars 19. The two bars 19 are connected to the cross members 22, placed in a radial position.

The cross members 22 may be placed corresponding to the two uprights 23 of each sector 17. An upright 23' is added to the two uprights 23, in the area of the separating arc 18 between the two semi-sectors 17', having the aim of absorbing any vertical force that could be generated if the position of the uprights 23 were not exactly in the centre of gravity of said semi-sectors 17, 17' and also to give stability to the semi-sectors 17, 17' themselves.

It should be noted that the best condition is the one in which the uprights 23 are in the centre of gravity of the semi-sectors 17'. In this case the vertical stresses in the arc 18 that divides the two semi-sectors 17' are cancelled and the division may be used as a thermal expansion joint. Moreover, the fact that the cross member 22 is not stressed by the loads transmitted to the hearth corresponding to the upright 23' allows the avoidance of possible phenomena of deflection of the beam, thus optimising the work of the wheels 26 on the rails 20.

In the FIG. 2 are shown circumferential sets of columns 30 (in this case four) in such a way that the columns 30 are aligned in groups on the same radii of concentric circumferences, where these radii are spaced at equal distances on the same circumferences. The number of these groups of columns 30 is equal to that of the sectors 17.

More particularly, with reference to FIGS. 2 and 3, two of the four circumferences, on which the columns 30 are placed, may be equal to the circumferences on which are placed the supports 25 for the wheels 26, and these supports 25 are located on the base 28 corresponding to each column 30.

As the columns 30 are designed in such a way as to have all the same vertical deflection under the load of the hearth 14, the stresses on the hearth 14, due to changing of the points of application of the load of the bars 19 on the wheels 26 during rotation, are thus minimised.

Instead, if the columns 30 cannot be positioned as described, the support structure 16 must be designed in such a way that the vertical deflection of the wheels 26 is as identical as possible.

Figure 5:
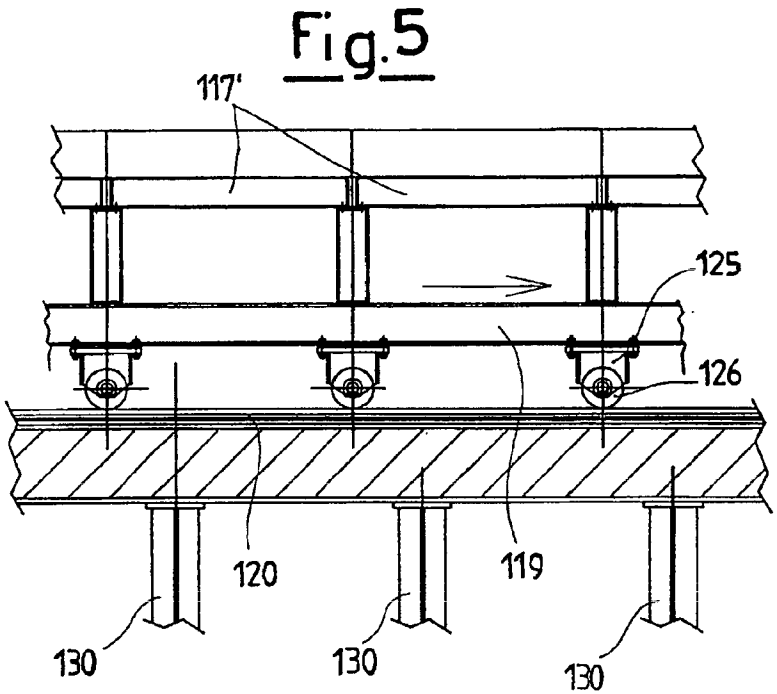
FIG. 5 is a side elevation section enlarged and developed on the plane, partly showing means for rotating the hearth according to the realisation in FIG. 4, with wheels placed on the mobile structure of the furnace.
Figure 4:
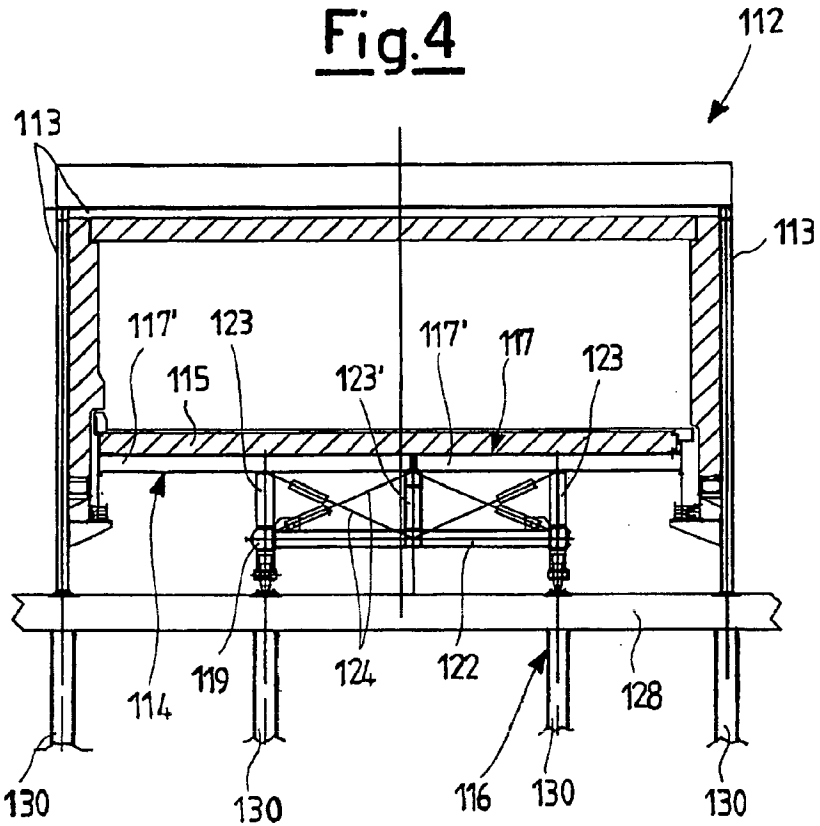
FIG. 4 is a side elevation section, made according to a radial plane of half the furnace, of a second realisation of a rotary hearth furnace for use in the iron and steel industry.

FIGS. 4 and 5 illustrate a further possible practical embodiment of the invention, where the components equal to and/or equivalent to those illustrated in FIGS. 1, 2 and 3 are marked with the same reference numbers, increased by 100.

This second embodiment differs from the first only in the fact that the reciprocal position between the supports 25 of the wheels 26 and the rails 20 indicated in the first embodiment is inverted.

As may be seen in FIGS. 4 and 5, in this embodiment the rails 120 are fixed to the base 128.

Instead the supports 125 are anchored below the annular bars 119. More precisely, the supports 125 are paired and positioned on the same radii of the two concentric circumferences of the bars 119, spaced at equal distances on the circumferences themselves. The number of these pairs of supports 125 is equal to that of the sectors 117. Moreover the supports 125 are fixed corresponding to the uprights 123 of the reticular structure that holds up the hearth 114.

In so far as regards the support structure 116, the precaution is always taken to position the circumferential sets of columns 130 in such a way that they are aligned, in groups, on the same radii of the concentric circumferences, where the radii are spaced at equal distances on the circumferences themselves. The number of these sets of columns 130 is equal to that of the sectors 117.

In this way the wheels 126 of the hearth 114, spaced at equal distances in the same way as the columns 130, do not exert any differential stress on the hearth 114 when this is being rotated. The hearth is in fact subject to a uniform lifting and lowering movement due to the deflection of the rails 120 and of the underlying support structure 116. It does not produce stress on the structure of the hearth 114 and does not induce movements in the refractory material 115 placed above it.

Finally, a rotary hearth furnace for use in the iron and steel industry according to the invention, where the structure that supports the hearth has a median radius equal to the one by which the hearth is divided into two concentric annuli having the same load, stresses the wheels of the two internal and eternal circumferences in an identical or very similar manner.

In this way the behaviour of the wheels is the same and the construction can be simplified by using wheels and rails of the same size.

In addition to simplifying the construction, and therefore also the maintenance, there are other advantages, such as an improvement in accessibility to the furnace seals.

Moreover, with maximum benefit when the width of the furnace is considerable, it is possible to divide the hearth structure not only radially into sectors, but also by splitting it along the circumference into semi-sectors; this is facilitated by positioning the wheels almost on the centre of gravity with respect to the two semi-sectors and thus minimising stresses in the area where the sectors are divided into semi-sectors and torsional stress on the annular bars.

These semi-sectors generate various benefits. Above all, the torsional effect on the support structures of the rails or wheels mounted on the hearth is eliminated or minimised. Then there is a reduction of the maximum radial heat expansion on the sectors of the structure because this is now divided into two semi-sectors, anchored in the centre. Lastly, dividing the sectors into semi-sectors, the total bending value of the hearth sectors, due to the differences in temperature between the top and the bottom of the metal structures which make up said sectors, is reduced with respect to the solution without semi-sectors.

From the above description with reference to the figures, it appears evident that a rotary hearth furnace for use in the iron and steel industry with large dimensions according to the invention is particularly useful and advantageous. The aims mentioned in the introduction to the description are thus achieved.

The forms of the rotary hearth furnace for use in the iron and steel industry according to the invention can of course be different from the one shown purely as an example without limitation in the drawings, just as the materials may be different.

The area of protection of the invention is therefore defined by the enclosed claims.

What is claimed is:

1. Rotary hearth furnace for use in the iron and steel industry, comprising a furnace (12, 112) with plan in the shape of an annulus, closed at the bottom by a rotary hearth (14, 114), lined at the top with refractory material (15, 115), and a base (28, 128; 30, 130) of the furnace (12, 112), wherein said hearth (14, 114) comprises a plurality of sectors of an annulus (17, 117; 17', 117'), all the same as one another and connected to form an annulus, complementary to that of the internal plan of the furnace (12, 112), which rotate around the central axis of the annulus, by means of two concentric sets of wheels (26, 126) arranged according to two circumferences, set at equal distances, with supports (25, 125), fixed to the base (28) or below the hearth (114), complementary to two circular rails (20, 120), fixed respectively below the hearth (14) or the base (128), wherein both said sets of wheels (26, 126) and said two rails (20, 120) are positioned in such a way as to have an equal load distribution and wherein both said sets of wheels (26, 126) and said two rails (20, 120) are positioned symmetrically with respect to a circumference which divides the annulus of the hearth (14, 114) into two concentric annuli loaded in the same way, said circumference being larger than the median circumference of said annulus of the hearth (14, 114).

2. Rotary hearth furnace for use in the iron and steel industry, comprising a furnace (12, 112) with plan in the shape of an annulus, closed at the bottom by a rotary hearth (14, 114), lined at the top with refractory material (15, 115), and a base (28, 128; 30, 130) of the furnace (12, 112), wherein said hearth (14, 114) comprises a plurality of sectors of an annulus (17, 117; 17', 117'), all the same as one another and connected to form an annulus, complementary to that of the internal plan of the furnace (12, 112), which rotate around the central axis of the annulus, by means of two concentric sets of wheels (26, 126) arranged according to two circumferences, set at equal distances, with supports (25, 125), fixed to the base (28) or below the hearth (114), complementary to two circular rails (20, 120), fixed respectively below the hearth (14) or the base (128), wherein both said sets of wheels (26, 126) and said two rails (20, 120) are positioned in such a way as to have an equal load distribution and wherein both said wheels (26, 126) of the two sets are the same as one another, and that said rails (20, 120) have the same section.

3. Rotary hearth furnace for use in the iron and steel industry, comprising a furnace (12, 112) with plan in the shape of an annulus, closed at the bottom by a rotary hearth (14, 114), lined at the top with refractory material (15, 115), and a base (28, 128; 30, 130) of the furnace (12, 112), wherein said hearth (14, 114) comprises a plurality of sectors of an annulus (17, 117; 17'117'), all the same as one another and connected to form an annulus, complementary to that of the internal plan of the furnace (12, 112), which rotate around the central axis of the annulus, by means of two concentric sets of wheels (26, 126) arranged according to two circumferences, set at equal distances, with sonorous (25, 125), fixed to the base (28) or below the hearth (114), complementary to two circular rails (20, 120), fixed respectively below the hearth (14) or the base (128), wherein both said sets of wheels (26, 126) and said two rails (20, 120) are positioned in such a way as to have an equal load distribution wherein said sectors (17, 117) are divided into two semi-sectors (17', 117') along arcs (18) of an intermediate circumference between the two end circumferences, internal and external, of the annulus of the hearth (14, 114), said arcs (18) dividing the sectors (17, 117) into two equally loaded semi-sectors (17', 117').

4. Rotary hearth furnace according to claim 3, wherein said semi-sectors (17', 117') are connected to the rails (20), or, respectively, to the supports (125) of the wheels (126) by means of vertical uprights (23, 123), positioned corresponding or close to their centre of gravity.

5. Rotary hearth furnace for use in the iron and steel industry, comprising a furnace (12, 112) with plan in the shape of an annulus, closed at the bottom by a rotary hearth (14, 114), lined at the top with refractory material (15, 115), and a base (28, 128; 30, 130) of the furnace (12, 112), wherein said hearth (14, 114) comprises a plurality of sectors of an annulus (17, 117; 17', 117'), all the same as one another and connected to form an annulus, complementary to that of the internal plan of the furnace (12, 112), which rotate around the central axis of the annulus, by means of two concentric sets of wheels (26, 126) arranged according to two circumferences, set at equal distances, with supports (25, 125), fixed to the base (28) or below the hearth (114), complementary to two circular rails (20, 120), fixed respectively below the hearth (14) or the base (128), wherein both said sets of wheels (26, 126) and said two rails (20, 120) are positioned in such a way as to have an equal load distribution and wherein said base (28, 128) is held up by a support structure (16, 116), comprising concentric circumferential sets of columns (30, 130), aligned in groups on the same radii of said circumferences, where said radii are spaced at equal distances from one another, and having the same number of sectors (17, 17').

6. Rotary hearth furnace according to claim 5, wherein said groups of columns (30, 130) are of the same number as the sectors (17, 117) of the hearth (14, 114), said columns (30, 130) having the same deflection under the load of the hearth (14, 114).

7. Rotary hearth furnace according to claim 6, wherein said sectors (17, 117) are divided into two semi-sectors (17', 117') along arcs (18) of an intermediate circumference between the two end circumferences, internal and external, of the annulus of the hearth (14, 114), where said arcs (18) divide the sectors (17, 117) into two equally loaded semi-sectors (17', 117'), said semi-sectors (17', 117') being connected to the rails (20), or, respectively, to the supports (125) of the wheels (126) by means of vertical uprights (23, 123), positioned corresponding or close to their centre of gravity.

8. Rotary hearth furnace for use in the iron and steel industry, comprising a furnace (12, 112) with plan in the shape of an annulus, closed at the bottom by a rotary hearth (14, 114), lined at the top with refractory material (15, 115), and a base (28, 128; 30, 130) of the furnace (12, 112), wherein said hearth (14, 114) comprises a plurality of sectors of an annulus (17, 117; 17', 117'), all the same as one another and connected to form an annulus, complementary to that of the internal plan of the furnace (12, 112), which rotate around the central axis of the annulus, by means of two concentric sets of wheels (26, 126) arranged according to two circumferences, set at equal distances, with supports (25, 125), fixed to the base (28) or below the hearth (114), complementary to two circular rails (20, 120), fixed respectively below the hearth (14) or the base (128), wherein both said sets of wheels (26, 126) and said two rails (20, 120) are positioned in such a way as to have an equal load distribution and wherein both said sets of wheels (26, 126) are aligned, two by two, on the same radii of the two concentric circumferences of the two sets of wheels (26, 126), and are of the same number as the sectors (17, 117) and wherein said sectors (17, 117) are divided into two semi-sectors (17', 117') along arcs (18) of an intermediate circumference between the two end circumferences, internal and external, of the annulus of the hearth (14, 114), said arcs (18) dividing the sectors (17, 117) into two equally loaded semi-sectors (17', 117').

9. Rotary hearth furnace according to claim 8, wherein said semi-sectors (17', 117') are connected to the rails (20), or, respectively, to the supports (125) of the wheels (126) by means of vertical uprights (23, 123), positioned corresponding or close to their centre of gravity.

* * * * *

UNITED STATES PATENT AND TRADEMARK OFFICE

CERTIFICATE OF CORRECTION

PATENT NO. : 6,966,770 B2
APPLICATION NO. : 10/484233
DATED : November 22, 2005
INVENTOR(S) : Paolo Bonci et al.

It is certified that error appears in the above-identified patent and that said Letters Patent is hereby corrected as shown below:

On the title page, item [75] 2nd inventor should read -- Giuseppe Facco --.

Signed and Sealed this

Eleventh Day of July, 2006

JON W. DUDAS
*Director of the United States Patent and Trademark Office*